United States Patent [19]

Ebbing et al.

[11] 4,449,442

[45] May 22, 1984

[54] HYDRAULIC VALVE CONTROL AND FEEDBACK UTILIZING A HARMONIC DRIVE DIFFERENTIAL

[75] Inventors: Steven J. Ebbing; Robert J. Hermans, both of Rockford, Ill.

[73] Assignee: Sundstrand Corporation, Rockford, Ill.

[21] Appl. No.: 337,193

[22] Filed: Jan. 5, 1982

[51] Int. Cl.[3] ..... F15B 15/26

[52] U.S. Cl. ..... 91/44; 91/45; 74/640; 74/805

[58] Field of Search ..... 74/640, 805; 91/44, 91/45, 381, 368; 60/388

[56] References Cited

U.S. PATENT DOCUMENTS

| | | | |
|---|---|---|---|
| 2,820,600 | 1/1958 | Brunner | 91/2 |
| 2,966,808 | 1/1961 | Grudin | 74/805 |
| 3,214,999 | 11/1965 | Lapp | 74/805 |
| 3,662,550 | 5/1972 | Lichtfuss | 91/363 A |
| 3,918,326 | 11/1975 | Kida et al. | 74/805 |
| 4,338,831 | 7/1982 | Rodaway | 74/805 |

*Primary Examiner*—Robert E. Garrett
*Assistant Examiner*—S. Moritz
*Attorney, Agent, or Firm*—Ted E. Killingsworth; Michael B. McMurry; Harold A. Williamson

[57] ABSTRACT

This invention relates to a motor control unit and a feedback arrangement to minimize the effects of backlash in a rotary output system. The system includes a source of energy. The motor control has a directional control element moveable from a null position. The motor control unit is coupled to the source of energy and to a motor which in turn is coupled to the rotary output and to a second input of a differential harmonic drive that has first and second inputs and an output. The first input of the differential harmonic drive is coupled to a rotational command input unit and the differential harmonic drive output is drivingly coupled to the moveable direction control element. In response to a given rotational command input when the second input is in an initial static position, whereupon the motor is coupled to the source of energy through the motor control unit, the rotary output is driven a precise number of revolutions dependent upon the given rotational command input. The second input is simultaneously driven a given number of revolutions in a direction to provide feedback, such that the differential harmonic drive output moves to return the moveable element to the null condition, and the system is then in a condition to respond to additional rotational command input.

14 Claims, 7 Drawing Figures

HYDRAULIC VALVE CONTROL AND FEEDBACK UTILIZING A HARMONIC DRIVE DIFFERENTIAL

TECHNICAL FIELD

This invention relates to a motor control and feedback arrangement to minimize the effects of backlash in a rotary actuation system.

BACKGROUND ART

Over the years the controlled movement of aircraft light control surfaces such as the flaps on the aircraft wings have progressed from pure mechanical systems that linked the flight control surfaces with a pilot control lever in the cockpit to hydraulic servo motor arrangements controlled from the cockpit and these hydraulic servo motor arrangements have become increasingly complex. There is little doubt that the emerging sophistication in the hydraulic valve arrangements utilized to control the servo motor or motors involved have improved performance. However, the improved performance has carried with it the burden of increased weight and multiply dependent interconnected components that inherently fall prey to malfunction and lost motion between components. Simply stated, with more components in a system there is statistically a greater probability of malfunction and backlash due to lost motion. It has always been a basic desire of flight surface control systems to provide a precision movement of the flap or a control surface in response to the movement of a pilot controlled stick or lever in the aircraft's cockpit.

Typical of the earlier efforts is the aircraft control surface assembly and actuating mechanism of M. Brunner described in U.S. Pat. No. 2,820,600. The Brunner assembly is a relatively uncomplicated hydraulic-mechanical mechanism that includes a rotary hydraulic motor which assumes and is maintained in a stalled atitude during such times as certain operating parts of the mechanism assume predetermined relative positions. The Brunner arrangement requires that the hydraulic motor that drives the flap between a retracted and fully extended position be driven into a stalled condition after a fixed number of revolutions. The Brunner arrangement is unable, as the invention to be described hereinafter, to position the flight control surface at an intermediate position.

Some years later, G. E. Lichtfuss created an actuator system shown and described in U.S. Pat. No. 3,662,550. The Lichtfuss actuator system for flight control surfaces includes a drive shaft 20 for actuating the flight control surfaces, a pair of hydraulic motors 39, 40 for driving the shaft, separate control circuits, FIG. 2, for the motors 39, 40 supplied from separate sources of pressure fluid. A normally operable selector valve 52 allows for the simultaneous energization of both control systems to operate both motors to drive the shaft. A free wheeling valve 60, 62 in each circuit enables either motor to be driven by the shaft in event of pressure failure in its circuit. A feedback mechanism 46 is adapted to neutralize both hydraulic systems when appropriate flight control surface adjustment has occurred. The feedback arrangement 46 is coupled to a valve stem 140 in selector valve 52 which is controlled by a rotatable shaft 175. The shaft 175 is mounted for pivoted movement back and forth and has an arm 179 engaging valve stem 140. The shaft 175 is adapted to be pivoted through the medium of an arm 176 fixed on the shaft and recessed at 177 to receive a driving pin 178 projecting axially from a rotatable disc 180, having a partial internal ring gear 181 integral therewith. The ring gear 181 is part of a differential mechanism including a planet gear 183 on a rotatable carrier 184, adapted to be pivoted by a lever 186 subject to control by the aircraft pilot. The differential mechanism further includes a sun gear 190 rotatable with a worm gear 192. The worm gear is driven by a worm 193 on a shaft 194 having a gear 195 adapted to be driven by a gear 196 on drive shaft 20. The Lichtfuss actuator system achieves position and control of the flight surfaces through the use of a complicated valving and a feedback mechanism described next above. The Lichtfuss system is further complicated by the incorporation of dual torque summing hydraulic systems. The invention to be described hereinafter provides all of the functional advances of the Lichtfuss actuator system, but with significantly fewer parts.

DISCLOSURE OF INVENTION

More specifically, this invention relates to a motor control unit and a feedback arrangement to minimize the effects of backlash in a rotary output system. The system includes a source of energy. The motor control has a directional control element moveable from a null position. The motor control unit is coupled to the source of energy and to a motor which in turn is coupled to the rotary output and to a second input of a differential harmonic drive that has first and second inputs and an output. The first input of the differential harmonic drive is coupled to a rotational command input unit and the differential harmonic drive output is drivingly coupled to the moveable direction control element. In response to a given rotational command input when the second input is in an initial static position, whereupon the motor is coupled to the source of energy through the motor control unit, the rotary output is driven a precise number of revolutions dependent upon the given rotational command input. The second input is simultaneously driven a given number of revolutions in a direction to provide feedback, such that the differential harmonic drive output moves to return the moveable element to the null condition, and the system is then in a condition to respond to additional rotational command input.

It is therefore a primary object of this invention to provide an aircraft flap actuation system that transforms mechanical pilot input signals into precise proportional movement of the flaps by converting aircraft hydraulic power into rotary shaft power to drive the mechanical actuation system of the flaps.

Another object of the invention is to provide a flap actuation system that employs a mechanical input and a feedback arrangement for a hydraulic motor control valve that is compact, lightweight, is of low cost and has minimum backlash.

Yet another object of the invention is to provide a flight control surface actuation system that utilizes in a feedback arrangement a differential harmonic drive that results in a precise control of the number of revolutions a rotary output shaft experiences for any given rotational command input.

A final object of the invention is to provide in flap actuation systems, a feedback arrangement that utilizes a differential harmonic drive to provide minimum backlash in the feedback arrangement, which thereby results in a highly compact low cost unit that is light in weight.

In the attainment of the foregoing objects, the invention contemplates in its preferred embodiment a hydromechanical motor control valve and feedback to minimize the effects of backlash in a rotary output system. The system has a fluid pressure source and a motor control valve that has a valve element moveable from a null position. The motor control valve is hydraulically coupled to the fluid pressure source and to a reversible hydraulic motor, which in turn is coupled to the rotary output and to a wave generating input of a differential harmonic drive. A pilot controlled rotational command input is mechanically coupled to a flexspline input of the differential harmonic drive. The differential harmonic drive has a rigid circular output member that is drivingly coupled to the valve element to thereby control movement of the valve element in response to a given rotational pilot command input delivered to flexspline input when the wave generating input is in an initial static position, whereupon the hydraulic motor is coupled to the fluid pressure source through the motor control valve, and the rotary output is driven a precise number of revolutions dependent upon the given rotational command input. While the foregoing is transpiring, the wave generating input is simultaneously being driven a given number of revolutions in a direction to provide feedback such that the differential harmonic drive output represented by movement of the rigid circular output moves to return the valve element to the null condition, and the system is then in a condition to respond to an additional rotational command input.

In the preferred embodiment the flexspline input of the differential harmonic drive is drivingly coupled between the wave generating input and the rigid circular output member.

Other objects and advantages of the present invention will be apparent upon reference to the accompanying description when taken in conjunction with the following drawings:

BRIEF DESCRIPTION OF DRAWINGS

FIG. 3*a* shows in section, a motor control valve involved in the invention.

BEST MODE FOR CARRYING OUT THE INVENTION

Figure 1:
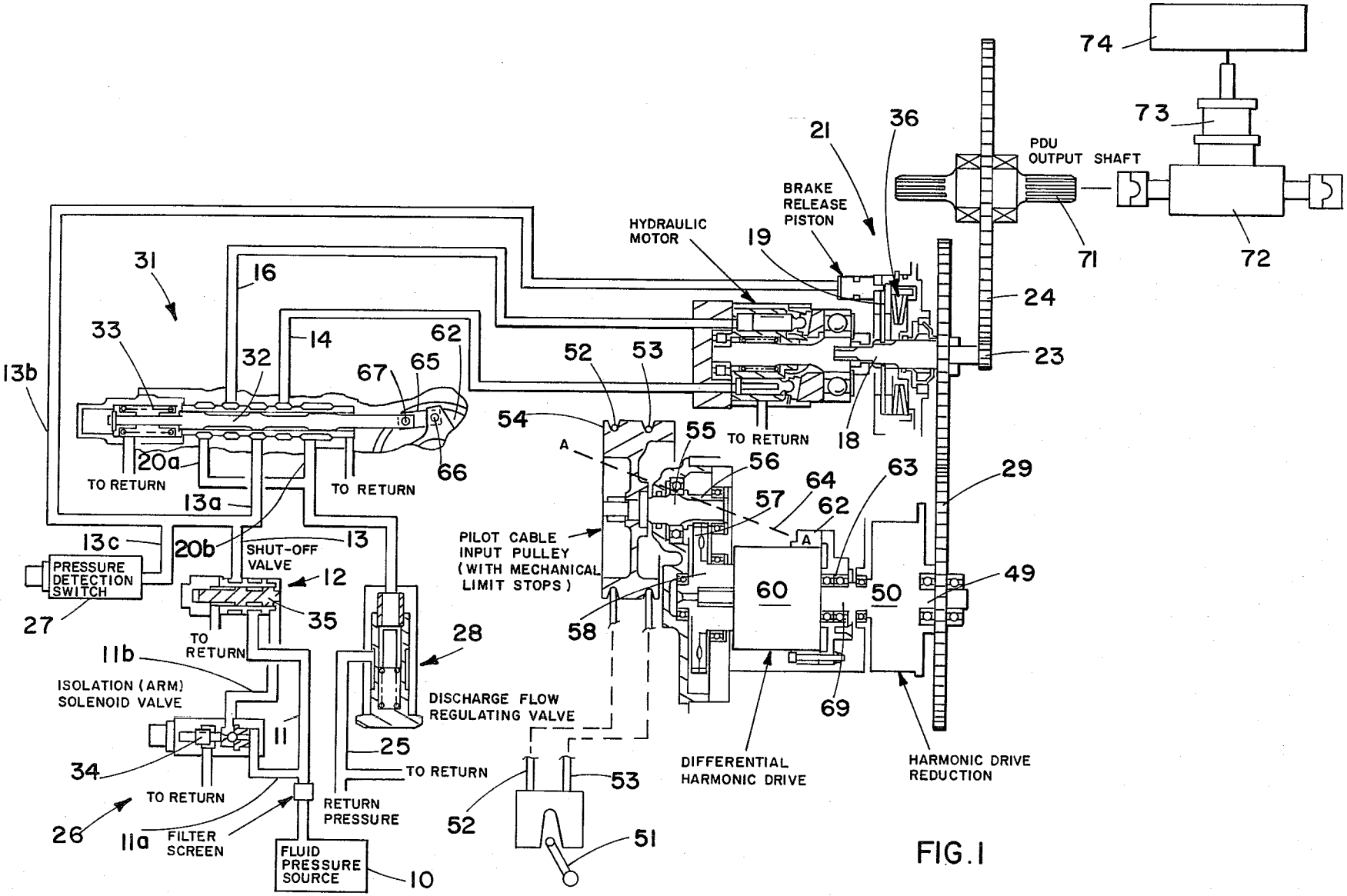
FIG. 1 is a diagramatic illustration of a preferred embodiment of power drive unit incorporating the invention.

Reference is now made to FIG. 1 which is a diagramatic illustration of the preferred embodiment of a power drive unit for the flight control surface actuation system of the invention. A review of the basic components of the system will now proceed. The major components include the following:

A fluid pressure source 10, a motor control valve 31, a reversible hydraulic motor 17, a rotary output shaft 71 coupled through a gear box 72 to a recirculating ball actuator 73 which in turn drives the flap or flight control surface 74 in any of an infinite number of positions, a differential harmonic drive 60 and a pilot control lever 51.

The fluid pressure source 10 is coupled to the reversible hydraulic motor 17 through the motor control valve 31 via conduits 11, 13, 13*a* and 14 or 16. The position of valve element 32 within the motor control valve 31 determines whether conduit 14 or 16 receives fluid under pressure from the source 10. By design, the pressurization of conduit 14 results in the hydraulic motor 17 being driven in a forward direction while the pressurization of conduit 16 results in the hydraulic motor 17 being driven in a reverse direction. The details of the reversible hydraulic motor will not be described as this unit is conventional in design. The schematic of the hydraulic motor 17 as shown should provide ample detail for one who has basic skills in the art to comprehend its operation. The hydraulic motor 17 has an output shaft 18 which carries a brake disc 19 keyed to the shaft 18 as shown. The brake disc 19 forms a part of a conventional fluid pressure actuated disc brake arrangement 21. The output shaft 18 additionally carries secured thereto a gear 22 which meshes with a gear 29 of a combined harmonic reduction drive 50 and differential harmonic drive 60 to be described more fully hereinafter. The output shaft 18 also has secured for rotation therewith a gear 23 which engages as shown, a gear 24 mounted for rotation with rotary output shaft 71. The rotary output shaft 71 is also referred to as the power drive unit (PDU) shaft. The shaft 71 is mechanically coupled to and through the gear box 72 to the recirculating ball actuator 73 which, in a wholly conventional manner moves the flap 74 to a position commanded by the movement of the pilot control lever 51.

Figure 2:
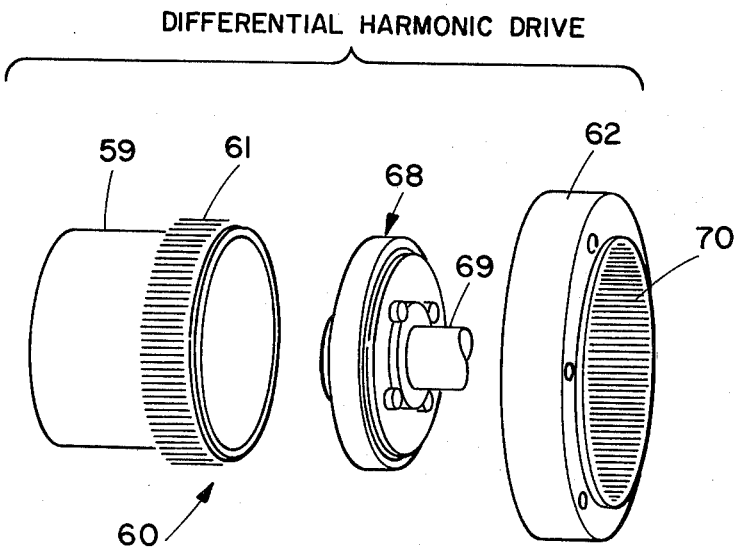
FIG. 2 is an exploded view of differential harmonic drive unit employed in the power drive unit of FIG. 1.
Figure 2A:
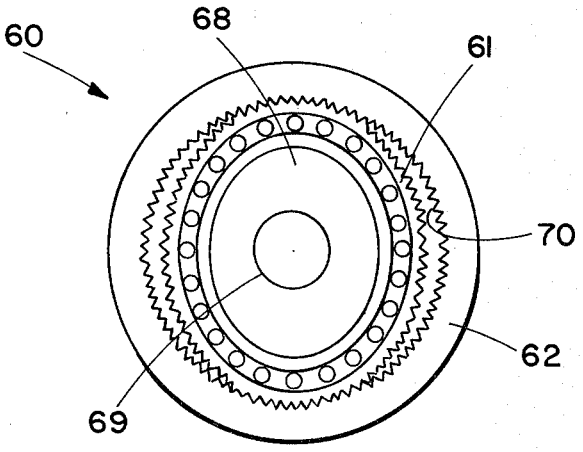
FIG. 2A is a view of the differential hormonic drive from the right of FIG. 2.

The pilot control lever 51 is secured to a pulley not shown, which carries cables 52, 53. Movement of the pilot control lever 51 causes the cables 52, 53, which are additionally carried by a pulley 54 to move the pulley 54 in a rotary manner. This rotary movement is referred to as a rotational command input. The rotational command input experienced by the pulley 54 is mechanically transmitted via a shaft 55 secured to the pulley 54, to toothed spline 56 on the shaft 55. A gear 57 engages the toothed spline 56 and transmits rotary input to a shaft 58 which is integral with the gear 57. The shaft 58 provides an input to the differential harmonic drive 60. Before continuing with a description of the system, attention is now directed to FIG. 2 which shows an exploded view of the differential harmonic drive 60. Though the simple details are not shown, it is to be understood that the shaft 58, which transmits a rotary input representative of the rotational command input, is coupled to a cylindrical flexspline 59 which has integral therewith at one end as shown, a flexspline gear teeth 61. Positioned within the cylindrical flexspline 59 is a wave generating input member 68 which has secured thereto an input shaft 69. The input shaft 69 can be seen in FIG. 1 supported by bearings 63. The shaft 69 represents one of the inputs to the differential harmonic drive 60, and also is the output of the harmonic reduction drive 50. The harmonic reduction drive 50 has an input shaft 49 which is secured for rotation with the gear 29 noted earlier. The gears 22, 29 and harmonic drive 50 provide reduction gearing between the hydraulic motor 17 and the differential harmonic drive 60, and constitute a portion of the feedback arrangement to be described more fully hereinafter. Returning again to FIG. 2, it will be observed that there is a rigid circular output member 62 with internal gear teeth 70 cooperate with flexspline gear teeth 61 as can best be seen in FIG. 2*a*. The illustration of FIG. 2*a* is to be understood as a schematic showing of the physical cooperation of the various components of the differential harmonic drive 60. A brief review of FIGS. 2 and 2*a* reveals that the differential harmonic drive 60 has a pilot controlled rotational input via flexspline 59, a wave generating input 68 with power delivered via shaft 69, and a rigid circular output member 62. The wave generating input 68 has an eleptical O.D. which is a thin race ball bearing as can be seen in FIG. 2*a*. The flexspline 59 is a non-rigid external spline wherein the teeth 61 number two less than the number of teeth 70 on the rigid circular member. The flexspline 59 is on a smaller pitch diameter when in its cylindrical free state.

Once again turning to FIG. 1 for an understanding of the description that follows, it will be seen that the rigid circular output member 62 which carries the reference character "A", and the unreferenced broken line which terminates to the left as FIG. 1 is viewed, there can be seen shown 90° out of plane, a portion of the output member 62. A pin 66, linkage 65 and a pin 67 mechanically couple the rigid circular output member 62 to one end of the valve element 32 as shown. In the description of the system operation that follows, it will be understood that movement of the valve element 32 is controlled in response to a given pilot initiated rotational command input when the wave generating input 68 is in an initial static position. Whereupon the hydraulic motor 17 is coupled to the fluid pressure source 10 through the motor control valve 31 and the rotary output shaft 71 is driven a precise number of revolutions dependent upon the given rotational command input. While the foregoing is transpiring, the wave generating input 68 is simultaneously being driven a given number of revolutions in a direction to provide feedback such that movement of the rigid circular output 62 moves to return the valve element to a null condition, and the system is then in a condition to respond to an additional rotational command input delivered from the pilot control lever 51. It will be noted that the motor control valve 31 is provided with a helical shaped null spring 33, which absent any mechanical forces to valve element 32, next to be described, will return the valve element 32 to a null position which results in neither of the conduits 14 or 16 receiving fluid under pressure, and therefore results in the cessation of rotary movement of the reversible hydraulic motor 17 and provides an important failsafe condition preventing uncommanded motion in the event of a failure in either the command input train (51 thru 58) or the feedback train (22 thru 69).

A number of additional components such as an isolation solenoid valve 26 connected via conduit 11*a* to the fluid pressure source 10; a shut off valve 12 connected by conduit 11*b* to the isolation solenoid valve 26 and by conduit 11 to the fluid pressure source 10, as well as to the motor control valve 31 via conduits 13, 13*a*, and to disc brake 21 via conduits 13 and 13*b*, will now be described. In conjunction with this description the functional cooperation of discharge flow regulating valve 28 which has a fluid return conduit 25, and is coupled to the motor control valve 31 via the conduit 20, will be explained.

The isolation solenoid valve 26 is a single stage unit, that is as can be seen, spring held in the closed position against hydraulic pressure from conduit 11*a*. Electrical energy must be present for the coil (not referenced) to move the plunger 34 against this spring force to open the valve.

The shut off valve 12 is intended to remove hydraulic supply fluid pressure originating from the fluid pressure source 10 to the motor control valve 31 when the systen is not moving. This is done to prevent errosion of the motor control valve 31, and to act as an additional safety feature against an open failure. The shut off valve 12 responds to hydraulic pressure signals via conduit 11*b* from the isolation solenoid valve 26 to move against a spring, not referenced, and high pressure experienced by a small area as shown where conduit 11 from fluid pressure source 10 enters the shut off valve. This arrangement keeps the valve closed when no command is present. When the spool 35 is moved by pressure forces from the isolation solenoid valve 26 delivered via conduit 11*b*, which pressure forces act on the large end of spool 35, supply pressure from fluid pressure source 10 is ported to the motor control valve via conduit 13 and the designated brake release pistons via conduits 13, 13*b*. The fluid pressure delivered to the brake release piston of the disc brake arrangement 21 via conduits 13, 13*b* unloads the friction surfaces that act upon the brake disc 19.

The motor control valve 31 responds to a mechanical input force delivered at the right hand end of valve element 32 via mechanical linkage 67, 65, 66 connected to the rigid circular output member 62 of the differential harmonic drive 60. The valve element 32 or spool, as it also may be termed, is normally spring centered, as described earlier, when no commands are present. When there is a command to move, the motor control valve element 32 moves against the null spring 33 to open one motor port to supply and the other to return. The valve is centered again when the desired position of the flap is reached, by means of a mechanical signal driving through the differential harmonic drive gearing 60.

The motor control valve 31 utilized in the preferred embodiment of the invention is underlapped on its return ports, and generates reasonable acceleration rates on opening, and the selected normal feedback closure rate gives a very soft deceleration. The worst case condition is that of a pilot decision to reverse movement of the control handle 51 at a high rate while the flap 74 is in motion. This results in reversing the porting to the motor and dumps system inertia into high hydraulic pressures and resulting torques. The configuration of control valve 31 illustrated will accept normal commands; feedback shut downs, and rapid reversals without exceeding hydraulic motor port allowable pressures or generating motor block lift, which can damage piston slippers.

The discharge flow regulator valve 28 is a commercially available flow regulator and its location in the conduits 20, 25 is intended to control the speed of the hydraulic motor 17.

Figure 3:
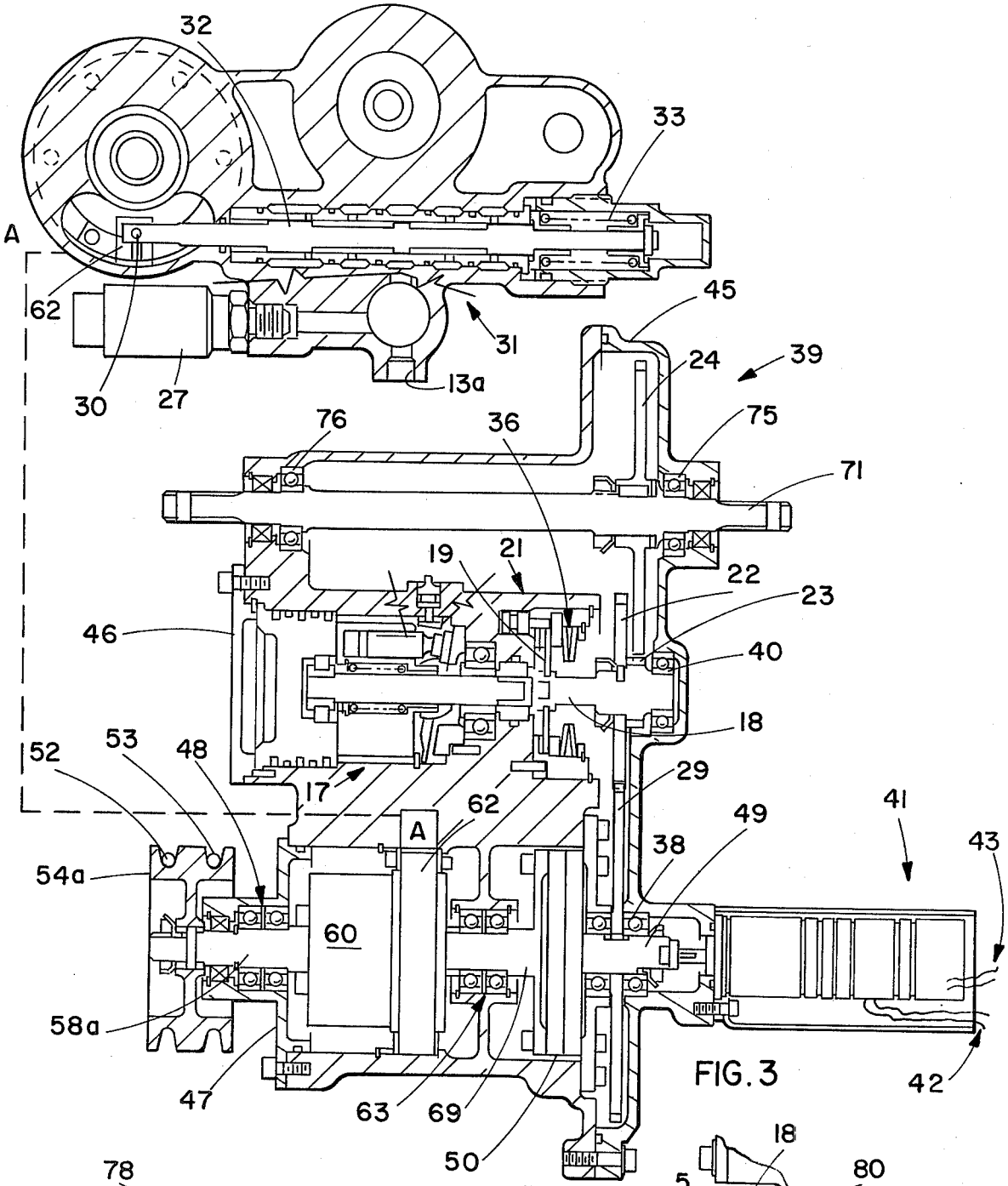
FIG. 3 is a structural illustration of the hydromechanical components of another embodiment of the invention.

The hydraulic motor 17 is in the preferred embodiment a nine piston axial, fixed displacement in-line hydraulic motor, which is uniquely incorporated directly into the motor control housing as best will be appreciated when FIG. 3 is discussed hereinafter. This arrangement obviates the need for a separate housing and associated mounting provisions. This arrangement also allows external fluid transfer lines from the valves to the motor to be eliminated. The hydraulic motor 17 is similar to those found in other in-line piston motors. The hydraulic motor case, not referenced, runs full of hydraulic oil thereby providing lubrication to all parts of the unit.

The disc brake 21 includes Belleville springs 36 to provide the force to clamp the brake disc 19 to thereby ground the hydraulic motor output when pressure is removed as noted earlier from conduit 13*b* and the designated brake release piston.

Reference is now made to FIG. 3 and FIG. 3*a*. FIG. 3 illustrates another embodiment of the invention in its most compact form. FIG. 3*a* depicts the control valve 31 shown 90° out of plane. FIGS. 3, 3*a*, 4 and 5 set forth a mechanical configuration of the components shown and described in respect of FIG. 1. FIGS. 3 and 3*a* differ principally in that the pulley 54*a* which corresponds to the pulley 54 of FIG. 1 is shown in FIG. 3 directly driving shaft 58*a*, rather than through reduction gearing 56, 57 as provided for in FIG. 1.

Figure 5:
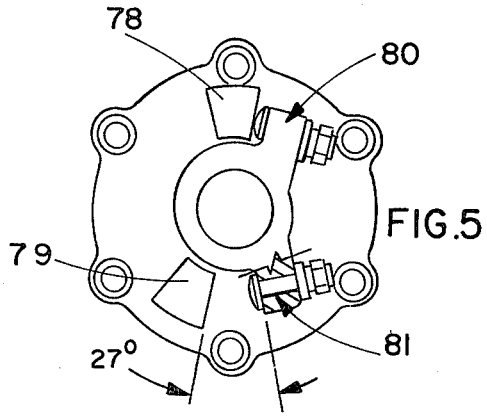
FIG. 5 is a view along the 5—5 of FIG. 4 which depicts the relative position of stop elements incorporated into the invention.
Figure 4:
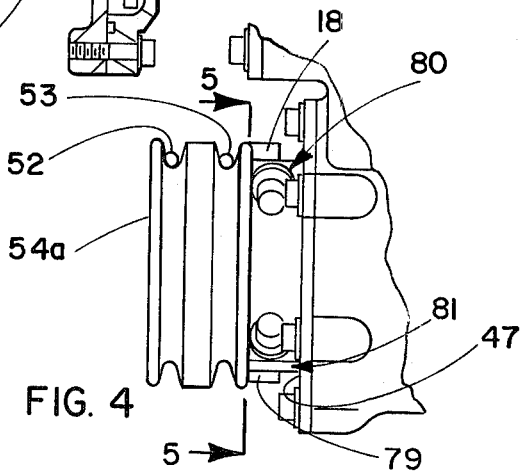
FIG. 4 is a partial illustration of the pilot controlled pulley arrangement shown in FIG. 1.

The description that follows in respect of FIGS. 3 to 5 will, whenever possible, utilize the same reference numerals to designate identical components present in FIG. 1 and FIGS. 3 to 5.

Referring now to FIG. 3, there is shown a power drive unit 39 which has a main housing 44 within which are packaged a number of the major components of the invention. The main housing 44 is provided with housing cover 45 secured to main housing 44. The housing cover 45 is constructed to permit the placement of bearings 75, 40 and 38. These bearings respectively support power output shaft 71, hydraulic motor output shaft 18 and harmonic reduction gear input shaft 49. The power output shaft is mounted at its other end in a bearing 76. The housing cover 45 has secured thereto a dual position potentiometer 41 which is provided with electrical leads 42, 43 which are connected to a display in the aircraft cockpit not shown. The dual position potentiometer 41 provides an indication in the aircraft cockpit of the flap position.

The left hand side of the main housing 44 as FIG. 3 is viewed is provided with a cover 46 secured thereto as shown and a bearing housing 47 which supports shaft 58*a* on bearings 48.

FIG. 3*a* illustrates in section the motor control valve 31 and differs slightly from that depicted in FIG. 1, in that rigid circular output member 62 is shown connected directly to valve element 32 via a pin 30.

Reference is now made to FIG. 4 which shows the pulley 54*a* and its relationship to bearing housing 47. The pulley has a pair of stops 78, 79 which cooperate with adjustable stop elements 80, 81 best seen in FIG. 5.

In FIG. 1, although not shown, it should be understood that a similar stop arrangement would be incorporated.

It should be kept in mind that flight surface control systems that employ recirculating ball actuators experience a significant number of revolutions to accomplish the mechanical displacement of the flight control surface or flap. In order that a command from the pilot accomplish this end it should be recognized that the command to move the flight control surface requires movement of a control lever through only a portion of a single revolution. Therefore, it follows that a fractional rotational input must produce a precisely defined multiple of the fractional input motion at the recirculating ball screw actuator. The invention just described performs this function with uncanny precision and does so with a physical configuration that is extremely compact and light in weight.

In the embodiment of the invention illustrated in FIGS. 3 to 5, the power drive unit requires a small rotation, i.e., 27°, FIG. 5 of input pulley 54*a* to produce a corresponding full flap extension at the power drive unit output shaft 71 and full flap extension is equivalent to 720 revolutions, and at the motor shaft 18, 3348 revolutions. The feedback mechanism which includes the reduction gears 22, 29, harmonic drive 50, differential harmonic drive 60 with output 62, has to reduce the 3348 revolutions to 0.500 inches of movement of the motor control valve element 32 to provide full surface authority.

The operation of invention as set forth in the embodiment of FIGS. 3 to 5 is as follows assuming a full travel authority command. The pulley 54*a* is rotated 27° while the hydraulic motor shaft 18 is held fixed by disc brake 21. This causes the wave generator shaft 69 of the differential harmonic drive 60 to be held fixed and the rigid circular member 62 to then rotate 27°. This rotation which is translated into a mechanical force on valve element 32 through pin 30 causes the valve element 32 to be displaced 0.500 inches thereby allowing hydraulic oil to be ported to the hydraulic motor 17. (A smaller input command will result in less than 27° of rotation and a correspondingly smaller amount of surface travel).

The hydraulic motor will rotate until the valve element 32 is recentered in the manner now to be described. The feedback system that accomplishes this recentering does so after the required number of revolutions necessary to accomplish a given command have been rotated. In this embodiment, the required number of revolutions of the hydraulic motor shaft 18 for full flap extension is 3348 revolutions. The spur gear reduction which includes gears 22, 29, reduces the required number of revolutions into the harmonic drive 50 to 1948 revolutions. The harmonic drive 50 further reduces the required revolutions to 12.237 into shaft 69 of the differential harmonic drive. Then, with the pilot controlled input pulley 54*a* held fixed, the rigid circular output member 62 of the differential harmonic drive 60 will rotate 0.076 revolutions, i.e., 27° in the opposite direction of the initial pilot input rotation of the pulley 54*a*. Accordingly, the initial 0.500 inch travel of valve element 32 will be nulled out by the effect of the feedback gear train.

By utilizing differential harmonic drive 60, the input pulley 54*a* rotation is nearly 1 to 1 to the valve element 32. The other input to the differential harmonic drive 60, which represents feedback, and appears on shaft 69, experiences as a result of the differential harmonic drive a reduction of 160 to 1. This allows a small input rotation for full valve element 32 travel and uses the large ratio just noted to reduce the large number of hydraulic motor shaft 18 revolutions back to 0.500 inch of valve element 32 travel. The systems accuracy is maintained by the differential harmonic drive as the differential harmonic drive is a zero backlash device such that there is no loss in motion between the input pulley 54*a* and the motor control valve element 32.

Although this invention has been illustrated and described in connection with the particular embodiments illustrated, it will be apparent to those skilled in the art that various changes may be made therein without departing from the spirit of the invention as set forth in the appended claims.

We claim:

1. A motor control means and feedback arrangement to minimize the effects of backlash in a rotary output system, said system comprising:

a source of energy, said motor control means having means moveable from a null position, said motor control means coupled to said source of energy and to a motor which in turn is coupled to said rotary output and to a second input of a differential harmonic drive that has first and second inputs and an output, said first input coupled to a rotational command input means and said output drivingly coupled to said moveable means in response to a given rotational command input when said second input is in an initial static position, whereupon said motor is coupled to said source of energy through said motor control means and said rotary output is driven a precise number of revolutions dependent upon said given rotational command input, said second input being simultaneously driven a given number of revolutions in a direction to provide feedback such that said differential harmonic drive output moves to return said moveable means to said null condition and said system is then in a condition to respond to an additional rotational command input.

2. The system of claim 1 wherein said differential harmonic drive is comprised of a flexspline input means, a wave generating input means and a rigid circular spline output means, said flexspline means drivingly coupled between said wave generating input means and said rigid circular output means.

3. The system of claim 2 where said flexspline input means is said first input, said wave generating input means is said second input and said rigid circular output means is said output of the differential harmonic drive.

4. The system of claim 3 wherein said motor is reversible.

5. The system of claim 4 wherein there is provided gear means to drivingly couple said hydraulic motor to said second input of said differential harmonic drive, said gear means including a harmonic drive reduction means.

6. A hydromechanical motor control valve and feedback arrangement to minimize the effects of backlash in a rotary output system, said system comprising:

a fluid pressure source, said hydromechanical motor control valve having a valve element movable from a null position, said valve hydraulically coupled to said fluid pressure source and to a hydraulic motor which in turn is coupled to said rotary output, and to a second input of a differential harmonic drive that has first and second inputs and an output, said first input coupled to a rotational command input means and said output drivingly coupled to said valve element to thereby control movement of said valve element in response to a given rotational command input when said second input is in an initial static position, whereupon said hydraulic motor is coupled to said fluid pressure source through said valve and said rotary output is driven a precise number of revolutions dependent upon said given rotational command input, said second input being simultaneously driven a given number of revolutions in a direction to provide feedback such that said differential harmonic drive output moves to return said valve element to said null condition and said system is then in a condition to respond to an additional rotational command input.

7. The system of claim 6 wherein said differential harmonic drive is comprised of a flexspline input means, a wave generating input means and a rigid circular spline output means, said flexspline means drivingly coupled between said wave generating input means and said rigid circular output means.

8. The system of claim 7 where said flexspline input means is said first input, said wave generating input means is said second input and said rigid circular output means is said output of the differential harmonic drive.

9. The system of claim 8 wherein said motor is reversible.

10. The system of claim 9 wherein there is provided gear means to drivingly couple said hydraulic motor to said second input of said differential harmonic drive, said gear means including a harmonic drive reduction means.

11. The system of claim 10 wherein there is provided a discharge flow control means coupled through said directional control valve to said hydraulic motor, said flow control means providing speed control for said hydraulic motor.

12. The system of claim 11 wherein valve element of said motor control valve is a spring centered spool.

13. The system of claim 12 wherein there is provided a pressure-off brake means coupled to hydraulic motor out, said brake responsive to fluid pressure from said source to thereby maintain said brake means in a released condition as long as fluid under pressure is being delivered to said motor control valve.

14. The system of claim 13 wherein said rotational command input means is controllingly coupled to an isolation valve, said isolution valve controllingly coupled to said fluid pressure source to thereby allow fluid under pressure to be delivered to said motor control valve and said pressure-off brake means only when said rotational command input means is moved from an off position towards a full rotational command input position.

* * * * *